United States Patent [19]

Madsen

[11] Patent Number: 4,915,382

[45] Date of Patent: Apr. 10, 1990

[54] COMPACTIBLE TENNIS RACQUET

[76] Inventor: Erik H. Madsen, 2405 Camino Way, Salt Lake City, Utah 84121

[21] Appl. No.: 202,520

[22] Filed: Jun. 6, 1988

[51] Int. Cl.[4] ..... A63B 49/08

[52] U.S. Cl. ..... 273/73 G; 273/73 J; 273/73 L

[58] Field of Search ..... 273/73 R, 73 C, 73 J, 273/73 G, 73 H, 73 L, 75, 67 R, 67 DA, 67 DB, 29 A, 193 B

[56] References Cited

U.S. PATENT DOCUMENTS

| | | | |
|---|---|---|---|
| 1,808,035 | 6/1931 | Guenard | 273/73 C |
| 4,094,505 | 6/1978 | Beall, Jr. | 273/73 C |
| 4,139,194 | 2/1979 | Fischer | 273/73 C |
| 4,746,119 | 5/1988 | Jeanrot | 273/73 C |

FOREIGN PATENT DOCUMENTS

| | | | |
|---|---|---|---|
| 1903722 | 8/1970 | Fed. Rep. of Germany | 273/73 C |
| 1489007 | 6/1967 | France | 273/73 C |
| 296927 | 12/1985 | Japan | 273/73 C |
| 3204 | of 1881 | United Kingdom | 273/73 C |
| 012750 | of 1886 | United Kingdom | 273/73 C |

*Primary Examiner*—Edward M. Coven
*Assistant Examiner*—William E. Stoll
*Attorney, Agent, or Firm*—M. Reid Russell

[57] ABSTRACT

A compactible tennis racquet having a head and a handle interconnecting by widely dispersed releaseable connections that will provide rigid coupling of the head to the handle, the connectors including handle extensions and head extensions, bolts for securing the handle extensions to the outer periphery of the head and bolts for connecting the head extensions to the handle extensions at a neck of the racquet and a hinge, provided at the neck of the racquet that provides for pivoting of the head with respect to the handle and that is locked against pivoting when the racquet is assembled for use.

5 Claims, 2 Drawing Sheets

COMPACTIBLE TENNIS RACQUET

BACKGROUND OF THE INVENTION

1. Field of the Invention

The present invention pertains to a game racquet and particularly game racquets that employ collapsible joints and frames.

2. Prior Art

Collapsible game racquets for use in tennis and similar sports have long been proposed. Such racquets consist generally of means permitting detachment of a handle from a head portion, so that the separated components are easier to carry and store than is a one piece racquet. A variety of such racquets have been proposed in the past, but they commonly are complex and expensive. In addition, many of the collapsible racquets are quite heavy and are not properly balanced as a result of coupling structures used. Furthermore, many of the coupling devices are cumbersome to use. Examples of known collapsible game racquets and associated couplings are found in U.S. Pat. Nos.:

1,026,990, (Matson)
1,548,134, (Gallaudet)
1,673,614, (Boening)
1,808,035, (Guenard)
1,832,298, (Greenspan)
2,109,799, (Moore)
2,463,621, (Herzog)
3,679,205, (Finkle, et al)
3,833,218, (Frenkel, et al)
4,007,929, (Figa)
4,052,060, (Balkcom)

These known collapsible game racquets, whether of a folding type or a take-apart type, provide for the handle and racquet head to be connected at a single point, usually at the base of the racquet head, i.e., in the neck formed between the head and the handle. Consequently a very strong, heavy coupling that will prevent twisting between the head and the handle is used. Such couplings are complex, expensive, and cumbersome, and add materially to the weight of the bracket and change the balance of the racquet. Disadvantages may well outweigh the convenience and ease of storage obtained by having a collapsible design. It is believed that a collapsible or take-down game racquet must be simple, easy to operate, and light in weight, yet at the same time be rigid, when assembled, and strong enough to withstand the shocks and twisting forces that are encountered in use in order to be widely accepted. None of the collapsible racquets of the prior art meet all these criteria.

OBJECTS OF THE INVENTION

A principal object of the present invention is to provide a compactible tennis racquet that, when assembled will have the strength, feel, balance and rebound characteristics of a conventional racquet.

Another object of the present invention is to provide a compactible tennis racquet that is strong, light weight and rigid during use so that twisting of the head relative to the handle will not occur during impact of the head with a ball.

Yet another object of the present invention is to provide a compactible tennis racquet that is easy to operate in changing it from a use made to a folded mode for storage or travel.

Still another object of the present invention is to provide a compactible tennis racquet that is relatively inexpensive and easy to manufacture.

FEATURES OF THE INVENTION

Principal features of the invention include a racquet head frame and a handle frame permanently attached by means of a hinge. The hinge allows the racquet head frame to fold down and rest against the handle frame. To secure the racquet head frame in an aligned position for use, widely spread lock means couple extensions of the head to the handle centrally of the axis through the head and handle and additional lock means are provided at outer connection points where extensions of the handle tangentially engage the outer edge of the head. The lock means used may comprise swinging bolts and nuts and the outer connection points may be at five o'clock and seven o'clock positions of the frame perimeter. This arrangement provides a balanced three point lock system, with greater strength and resistance to twisting than the single lock system of other known devices.

In one preferred embodiment proper alignment of the racquet head with regard to the handle is insured by the use of grooves framed in the extensions of the head and handle frame to align with pivoted bolts carried by the other frame member. The racquet head frame extensions overlap the handle to provide for the central connection and the handle frame extensions overlap the head to provide for the outer connections of the three point connection used.

In another embodiment bolt and nut means and a backing plate cooperate with the hinge to form the central locking structure.

Other objects and features of the invention will become apparent from the following detailed description and drawings disclosing what are presently contemplated as being the best modes of the invention.

THE DRAWING

In the drawing:

FIG. 1 is a plan view of a preferred embodiment of the compactible tennis racquet of the invention, as it appears when ready for use;

FIG. 2, a side elevation view of the racquet of FIG. 1;

FIG. 3, an enlarged partial cross-section of a typical securing means, taken on the line 3—3, of FIG. 2;

FIG. 4, a plan view of another preferred embodiment of the compactible tennis racquet of the invention; and FIG. 5, a side elevation view of the racquet of FIG. 3.

DETAILED DESCRIPTION

Figure 1:
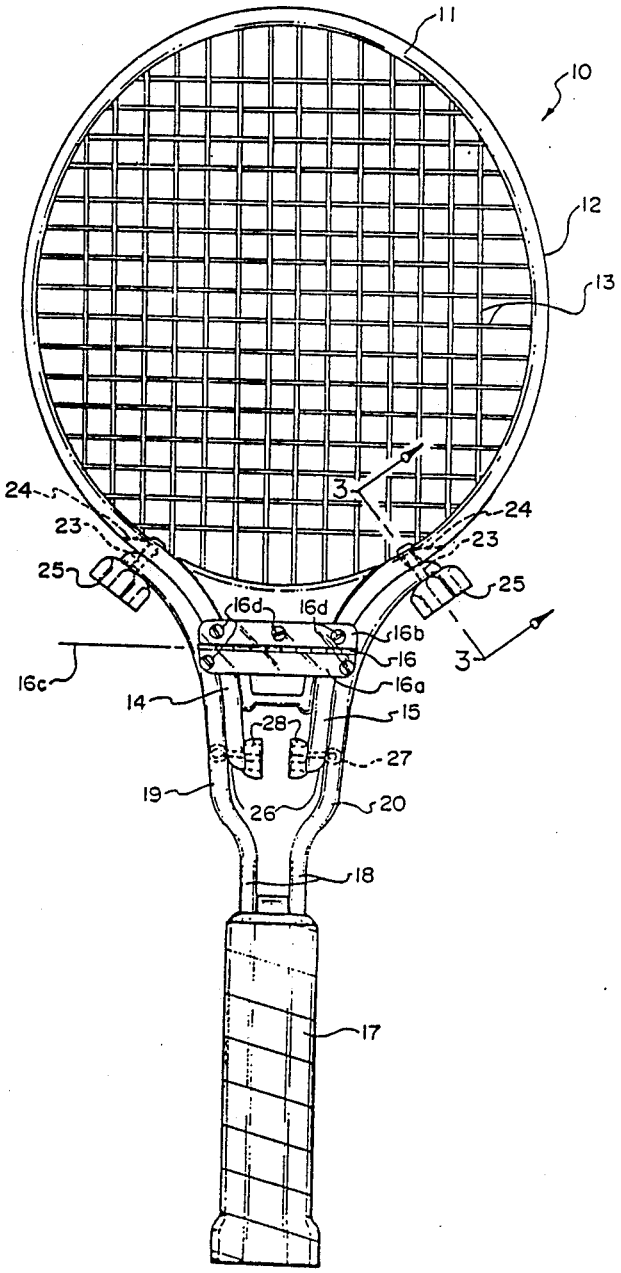
Figure 2:
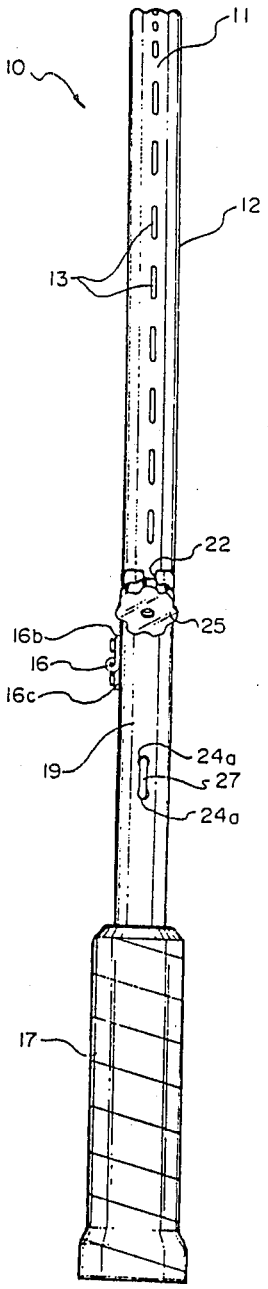

Referring now to the drawing:

In the illustrated preferred embodiment of the invention the racquet, is shown generally at 10 in FIG. 1. The compactible tennis racquet 10 includes a racquet head 11 having a frame 12 and a webbing 13. The head frame 12 has integral extensions 14 and 15 which are secured by screws 16 to one hinge plate **16*a* of a hinge 16. The racquet 10 also includes a handle 17, with a frame 18 and integral frame extensions 19 and 20 which are shaped to fit closely against the racquet head frame extensions 14 and 15, respectively, and to tangentially engage the frame 11 at five o'clock and seven o'clock positions. The handle frame 18 is secured to hinge plate 16*a* of hinge 16 by screws 16*d***.

In the preferred embodiment of the invention of FIG. 1, the frames 12 and 18, including the extensions 14 and 15 and 19 and 20 are made of a strong lightweight metal such as an aluminum alloy. The racquet 10 is designed to be carried or stored while folded to reduce space requirements and to be unfolded and secured to be used for playing tennis. The head and handle sections of the racquet 10 fold relative to one another about the pivot axis 16c of the hinge 16.

The ends of the handle frame extensions 19 and 20 each have a slot 22 formed therein, with each slot having a width just slightly greater than the diameter of a bolt 23. Each bolt 23 is permanently mounted to the head frame and is made to swing into and out of a slot 22. Each bolt 23 is inserted through a hole 24 through the head frame 12, with the head of the bolt recessed into the frame. Each hole 24 is flared from a recess for the bolt head to provide an enlarged slot at the outside of the frame that will allow upward pivoting of the bolt as viewed in FIG. 1. A nut 25 having an enlarged surrounding knob to provide for ease of grasping and turning is threaded onto each bolt 23. The nut is backed off to allow bolt 23 to be pivoted upwardly, lowered into slot 22 when the head and handle are to be interlocked and then is tightened to secure the extension 19 or 20 to the head frame 12. A similar locking arrangement is provided to interlock the head frame extensions 14 and 15 to the handle frame 18. A slot 26 is provided in the end of each extension 14 and 15 and a bolt 27, having a head recessed into the handle frame and extending through a hole 24a, flared into a slot (as previously described) to pivot into and out of slot 26, and a nut 28 having an enlarged surrounding knob is threaded onto each bolt 27.

To fold the racquet the nuts 25 and 28 are backed off (while being left on the bolts) and the bolts 23 and 27 are pivoted out of their slots 22 and 26, respectively. The racquet handle and head are then folded about the pivot axis 16c to place the handle across the webbing and frame of the head. Thus compacted, the racquet will readily fit into a suitcase or can be stored in a smaller area than can a one-piece racquet. A reverse operation is followed in assembling the tennis racquet for use.

Figure 3:
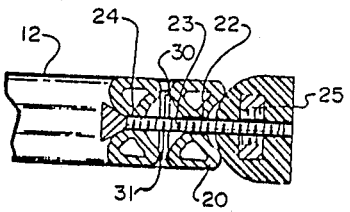

As best shown in FIG. 3, when the racquet is unfolded and assembled for use, interlocking surfaces 30 and 31, on the racquet head extension and handle extensions, respectively, are forced together by tightening of the nuts 25 and 28. These interlocking surfaces provide even additional stability to the assembled racquet.

Figure 4:
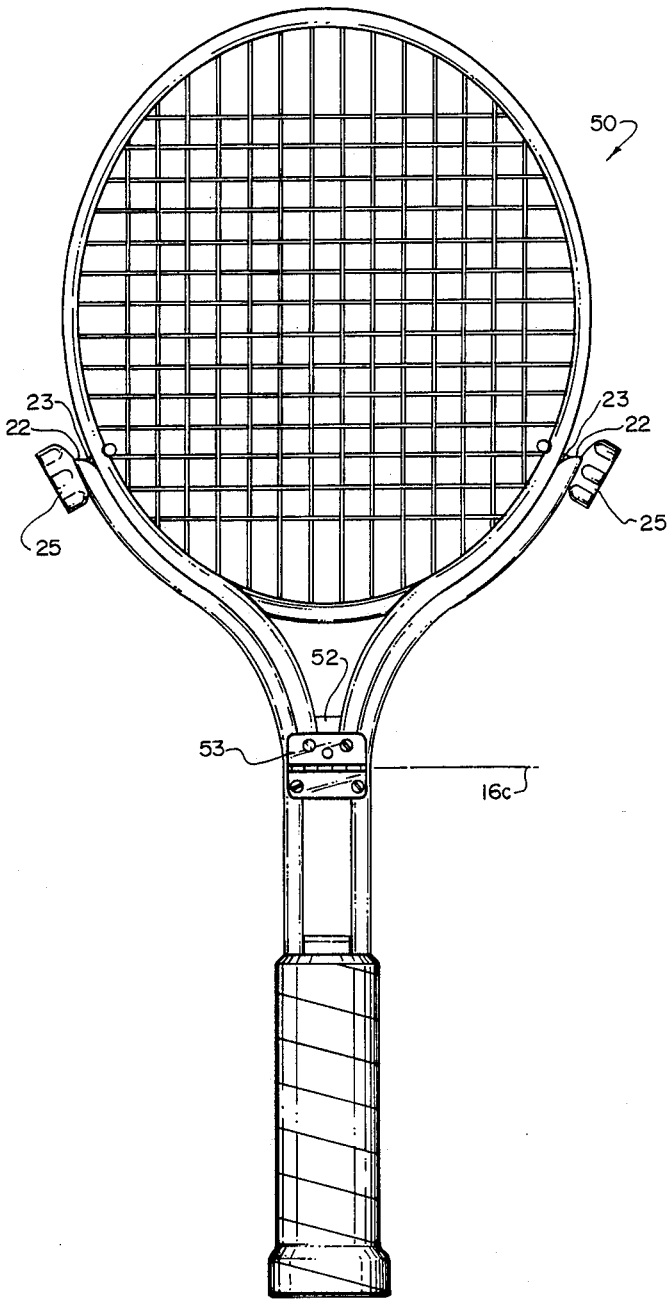
Figure 5:
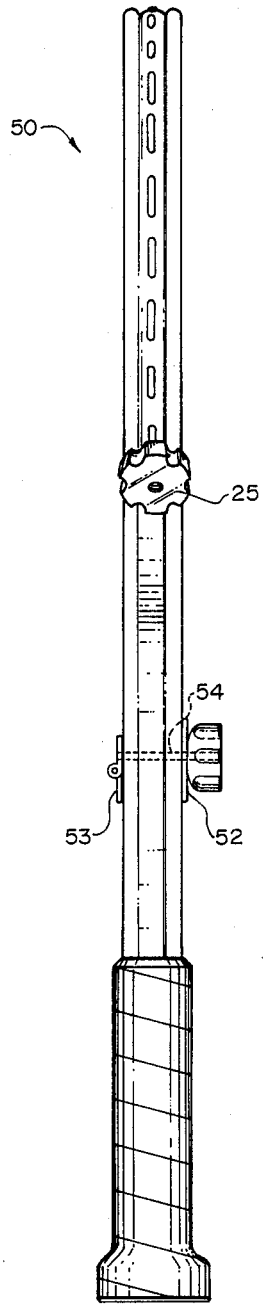

In the embodiment of the invention shown in FIG. 4, the racquet 50 is constructed in the same manner as the racquet 10 previously described, except for the locking means used to interconnect the extensions from the racquet head and the handle. In this embodiment, a plate 52, extend fully across both the handle and head extensions, and is connected to the hinge plate 53, to which the head extensions are connected by a bolt 54 having a knob on the head end thereof that is threaded into the hinge plate. When the bolt 54 is turned out of the hinge plate, and the nuts 25 are backed off so that bolts 23 can be pivoted at out of their slots 22, the head can be folded about the pivot axis 16c to place a handle across the web and frame of the head.

It can be seen, that in either embodiment of the invention, widely dispersed three point connections are provided to insure a rigid connection between handle and head for the assembled racquet.

Although preferred forms of my invention have been herein disclosed, it is to be understood that the present disclosure is by way of example and that variations are possible without departing from the subject matter coming within the scope of the following claims, which subject matter 1 regard as my invention.

I claim:

1. A compactible tennis racquet comprising a racquet head including a frame and a webbing within the frame, and head extensions extending from the periphery of the frame, at opposite sides thereof to a common central area;

a handle, said handle including a gripping portion and extensions projecting therefrom and shaped to be tangential to the periphery of the frame of the head;

means for releasably coupling each of said handle extensions to the frame of the head, at the periphery thereof; and means to releasably pivotally interconnect the head extensions and the handle extensions, at a neck of the racquet;

wherein the means to releasably couple the handle extensions and the frame of the head comprise bolts carried by the head and pivotable into slots in the handle extensions, and nuts threaded onto the bolts.

2. A compactible tennis racquet as in claim 1, wherein the means to releasably pivotally interconnect the head extensions and the handle extensions comprise a hinge having one hinge plate attached to the handle extensions, and a second hinge plate attached to the head extensions, and means to prevent folding of the hinge.

3. A compactible racquet as in claim 2, wherein the means to prevent folding of the hinge comprise a plate extending across the handle extensions and head extensions, and a bolt extending through said plate and threaded into the hinge plate attached to the head extensions.

4. A compactible racquet as in claim 2, wherein the means to prevent folding of the hinge comprises bolts, carried by the handle extensions, and pivotable into slots in the head extensions, and nuts carried by the bolts and adapted to be tightened thereon.

5. A compactible racquet as in claim 4, wherein extensions and the head extensions, to provide interlocked surfaces when the nuts are tightened on the bolts.

* * * * *